US009710992B2

(12) United States Patent
Borra

(10) Patent No.: US 9,710,992 B2
(45) Date of Patent: Jul. 18, 2017

(54) AUTOMATIC PRODUCT DISPENSING MACHINE

(75) Inventor: Paolo Borra, Busto Arsizio (IT)

(73) Assignee: RHEAVENDORS INDUSTRIES S.P.A., Como (IT)

( * ) Notice: Subject to any disclaimer, the term of this patent is extended or adjusted under 35 U.S.C. 154(b) by 529 days.

(21) Appl. No.: 13/704,877

(22) PCT Filed: Jun. 27, 2011

(86) PCT No.: PCT/IB2011/052809

§ 371 (c)(1),
(2), (4) Date: Feb. 4, 2013

(87) PCT Pub. No.: WO2012/001605

PCT Pub. Date: Jan. 5, 2012

(65) Prior Publication Data

US 2013/0211583 A1 Aug. 15, 2013

(30) Foreign Application Priority Data

Jun. 30, 2010 (IT) ..... MI2010A001190

(51) Int. Cl.
*G07F 11/00* (2006.01)
*G07F 9/02* (2006.01)

(52) U.S. Cl.
CPC ..... *G07F 11/00* (2013.01); *G07F 9/02* (2013.01); *G07F 9/023* (2013.01)

(58) Field of Classification Search
CPC ..... G07F 11/00; G07F 9/02; G07F 9/023
USPC ..... 700/232, 234
See application file for complete search history.

(56) References Cited

U.S. PATENT DOCUMENTS 4,554,419 A * 11/1985 King ..... G07F 9/02 200/317
4,682,709 A 7/1987 Brandes et al.
5,209,004 A 5/1993 Kirlin
5,831,862 A * 11/1998 Hetrick ..... G07F 9/026 221/8

(Continued)

FOREIGN PATENT DOCUMENTS

CA 1239680 A1 7/1988
EP 0823696 A2 2/1998

(Continued)

*Primary Examiner* — Michael K Collins
(74) *Attorney, Agent, or Firm* — Pearne & Gordon LLP

(57) ABSTRACT

An automatic product dispensing machine comprises: a frame (2) delimiting at least a housing chamber (3); a magazine (4) arranged internally of the housing chamber (3), for containing a series of products (5); at least a display (8) interposed between the housing chamber (3) and the external environment; a control unit (9) active on the display (8) and configured such as to enable visualizing images and/or information. The control unit (9) is further configured such as to switch the display (8) between at least two of the following three operative conditions: a visualizing condition, in which it reproduces at least a datum and/or image that is externally visible, a condition of transparency, in which at least a product (5) contained in the magazine (4) is viewable via the display (8) and a superposing condition, in which at least a product (5) is viewable via the display (8) and at least a datum and/or image and/or film relating to the product is reproduced on the display.

17 Claims, 5 Drawing Sheets

(56) References Cited

U.S. PATENT DOCUMENTS

| | | | | |
|---|---|---|---|---|
| 6,424,094 | B1 | 7/2002 | Feldman | |
| 6,480,204 | B1 | 11/2002 | Tognazzini et al. | |
| 7,299,576 | B2 * | 11/2007 | Martin et al. | 40/544 |
| 7,784,643 | B1 * | 8/2010 | Levine | G07F 9/026 221/155 |
| 7,881,822 | B2 * | 2/2011 | Thornton et al. | 700/244 |
| 7,978,184 | B2 * | 7/2011 | Morrison | 345/173 |
| 8,082,061 | B2 * | 12/2011 | Segal | G07F 9/02 221/2 |
| 8,170,713 | B2 * | 5/2012 | Levasseur | G07F 9/105 221/155 |
| 8,463,430 | B2 * | 6/2013 | Segal | G07F 9/02 221/8 |
| 8,473,864 | B2 * | 6/2013 | Segal | G06F 3/0488 715/764 |
| 8,527,089 | B2 * | 9/2013 | Meacock et al. | 700/236 |
| 8,683,745 | B2 * | 4/2014 | Artwohl | A47F 3/0434 49/70 |
| 8,781,622 | B2 * | 7/2014 | Mockus et al. | 700/237 |
| 9,052,536 | B2 * | 6/2015 | Artwohl | A47F 3/0434 |
| 2002/0097221 | A1 | 7/2002 | Schulterbrandt | |
| 2006/0039149 | A1 | 2/2006 | Jamnia et al. | |
| 2006/0247824 | A1 | 11/2006 | Walker et al. | |
| 2007/0016478 | A1 * | 1/2007 | Hill | G06Q 30/0251 705/14.49 |
| 2007/0061723 | A1 | 3/2007 | Ohga et al. | |
| 2008/0192027 | A1 | 8/2008 | Morrison | |
| 2010/0103131 | A1 * | 4/2010 | Segal | G07F 9/02 345/173 |
| 2010/0268792 | A1 * | 10/2010 | Butler | G06Q 30/02 709/217 |
| 2010/0275477 | A1 | 11/2010 | Kim | |
| 2013/0211583 | A1 * | 8/2013 | Borra | G07F 11/00 700/232 |

FOREIGN PATENT DOCUMENTS

| | | | |
|---|---|---|---|
| EP | 1783705 | A2 | 5/2007 |
| JP | 2001013898 | A | 1/2001 |
| JP | 2003122286 | A | 4/2003 |
| WO | 2007012899 | A1 | 2/2007 |
| WO | 2007055456 | A1 | 5/2007 |
| WO | 2008067698 | A1 | 6/2008 |
| WO | 2009027637 | A1 | 3/2009 |

* cited by examiner

AUTOMATIC PRODUCT DISPENSING MACHINE

FIELD OF THE INVENTION

The present invention concerns an automatic dispensing machine of products.

The object of the present description relates to an automatic dispensing machine of products such as, for example, ready-made food products or products for restaurants, or any other marketable article, such as magazines, newspapers, books, gift articles, spectacles and like objects which can be housed internally of the machine store and dispensed on request.

BACKGROUND

As is known, automatic product dispensing machines comprise a frame, generally having a parallelepiped shape delimiting a housing chamber internally of which one or more stores are provided for containing a series of products to be released.

The frame exhibits, at the front wall, a transparent glass destined to enable vision of the products contained in the store so that the user can make her or his choice after having seen the actual product which will be dispensed.

The machines also include one or more selection devices suitably located in the frame such as to enable a user to choose, after payment of the sum due via an appropriate unit of payment, one of the products present in the store.

With the aim of enabling release of the product from the store and the collecting of the released product, the machines are generally provided with at least a collecting compartment at which the released product is deposited after having been selected by the user who can therefore collect it.

The most modern machines can also include the presence of at least a display associated to the frame, in particular the front wall thereof, i.e. the wall on display to the public.

Typically the display is located at the sides of the glass pane such that the user can observe the products in the store and therefore move and read any information on the product in the display and select, via the keyboard or display, if of the touch-screen type, the desired product.

The display can be used for example in association with the selection device such as to enable selection of the products to be collected.

In some models of known machines the display is interposed between the housing compartment and the external environment and is connected to a control unit which has the task of managing it such as to visualise images and/or information visible to the user.

A further example of automatic dispensing machines is described and illustrated in document CA1239680. This machine comprises a panel selecting system, sensitive to contact and the manual pressure of the user.

In detail, the panels comprise a transparent selection membrane, sensitive to a user's pressure. The selection membrane is interposed between two strata or panels made of polycarbonate in a suitable configuration for defining a respective display.

The machine further comprises a series of selection windows realised on one of a polycarbonate strata. The selection windows are backlit and show, in a photograph or drawing, the images of the products which can be released and collected by the user.

Alternatively, the images are projected from inside onto a respective polycarbonate stratus, possibly together with names or logos of the product on sale, which are thus visible externally.

The selection of the products is done by pressing the selection membrane at the respective selecting window.

A further example of the machine described and illustrated in document WO2009/027637 comprises an automatic product dispensing machine provided with an LCD display that exhibits a sequence of images that are visible from the outside. The images reproduced on the LCD display are indicative of the products contained and on sale. Via the display the users can see representations of the products and select the product of interest thereafter, via a suitable selecting device arranged in the front part of the machine.

Also known, from document US20080192027, is a machine with an interactive display destined for automated sale of products.

The glass display window comprises a display arranged internally of the exhibition area separated from the external environment via the glass window. The display is obviously visible from outside via the window and reproduces, via a back-projection, images and/or information relating to the products on sale.

The window comprises a control unit able to perceive, through a series of suitable sensors, the position of the user's hand on the external part of the glass and verify the correspondence between the position of the hand and the position of the products visualised on the display located behind the glass screen.

Although these machines and/or automatic systems for product distribution enable automatic management of the sales thereof, the applicant has found that they are not without some drawbacks and are susceptible to improvement in various aspects, mainly in relation to the general perception that the user has of each product contained in the machine.

In particular, the present applicant has found that the transition automatic dispenser machines of products only enable visualisation of the products contained in the respective machine via a respective display window and require the use of separate systems for the selection.

Further, known machines, in the attempt to provide information relating to the products, alternatively introduce LCD monitors by the side of the glass or replace the glass with large-dimension monitors, which makes it impossible, for reasons of space, to house both the glass display screen and a large LCD monitor.

Contextually, the applicant has also found that the devices provided with displays only show information and/or images and/or films relating to products on sale without enabling real visualisation of the products contained in the stores which are then released, as happens in traditional dispensers today available on the market.

According to the prior art described above, the user cannot have a view and/or overall perception of the product on sale as in the first case it is without explanatory information on the products, and, in the second case, the user has an artificial view of the products without being able to view the real package present inside the magazine.

In documents which seek to obviate the above drawback monitors are positioned at the positions of the products internally of the housing chamber, such as to be able to visually access the products and the information relating to the products more easily.

It is however clear that the increase in costs and the complexity of the adopted solution has made the market for this type of distributor rather marginal.

SUMMARY

The main aim is to provide an automatic product dispensing machine able to resolve one or more of the problems encountered in the prior art.

Thus an aim is to realise an automatic product dispensing machine which can provide an overall perception of the products on sale to the users (and it may also possibly be interactive).

A further objective is to disclose a machine capable of having differentiated functioning types according to the operating situation in which it finds itself, thus optimising sales operations without reducing its ability to also be a publicity medium linked to the positioning of the machine itself in public places, generally places where there are high numbers of the public.

A further aim is to enable simple and intuitive use of the machine without having to sacrifice a high level of automation of the sales process.

The above-specified aim, and others besides, are substantially attained by an automatic product dispensing machine as explained and described in the following claims.

The automatic product dispensing machine comprises, in a first aspect, a frame delimiting at least a housing chamber; a magazine, operatively arranged internally of the housing chamber, the magazine being predisposed to contain a predetermined number of products; at least a display associated to the frame and interposed between the housing chamber and an external environment to the dispensing machine; a control unit acting on the display and configured such as to enable visualisation of images and/or items of information on the display; at least a portion of the display is transparent, enabling visual access to the housing chamber and the control unit is configured such as to be selectively active on at least the portion of the display in order to visualise images and/or items of information.

In a further aspect in accordance with the preceding one, the control unit is configured such as to be active on at least the portion of the display in order to switch the display between at least two of following three conditions:

a visualising condition, in which the display reproduces on at least a portion thereof an item of information and/or an image which is visible externally by a user and there is no substantial visual access to the housing chamber through the portion; a transparent condition, wherein at least a product contained in the magazine is visible through the portion of the display; a superposing position in which at least a portion of the display reproduces an item of information and/or an image which is visible externally to a user and at least a product contained in the magazine is at least partly visible through the portion.

In a further aspect, in accordance with any one of the preceding claims, the machine comprises a selecting device operatively associated to the frame in order to enable a user to select at least a product contained in the magazine; a collecting compartment associated to the frame in order to enable collection of at least a product released from the magazine; and wherein the control unit is configured such as to switch the portion of the display into the transparent condition in order to enable at least partial visibility of a real product contained in the magazine and predisposed to be released following a selection command emitted by the selecting device following an action of a user; the machine comprising at least a release unit of at least a product selected via the selecting device, the release device being active to move a real product visible from the outside in the transparent condition of the display towards the collecting compartment.

In a further aspect in accordance with any one of the preceding aspects, the control unit is configured such as to switch the portion of the display into the visualising condition in which the product contained in the magazine is not visible from outside, the display possibly being able to reproduce at least an item of information and/or an image of the product, selectable by the user via the selecting device.

In a further aspect, in accordance with any one of the preceding aspects, the machine further comprises at least a light source, in particular arranged internally of the housing chamber and acting on the magazine, switchable between a non-operating condition, in which it does not emit light, and an operating condition, in which it illuminates a predetermined number of products contained in the magazine, the control unit switching the light source from the non-operative condition to the operative condition, in particular when the control unit switches the display into the transparent condition.

In a further aspect in accordance with any one of the preceding aspects, the control unit is configured such as to switch the light source from the non-operative condition to the operative condition, when it switches the display into the superposing condition.

In a further aspect in accordance with any one of the preceding aspects, the control unit is configured such as to send to the display, when the display is in the visualising condition or in the superposing condition, a signal of reproduction of a menu, in particular interactive; and/or an item of information indicating the price of a product contained in the store; and/or an item of information indicating a description of a quality of quantity of at least a product contained in the store, such as for example the calories contained and/or the ingredients and/or the original; and/or at least an item of information relating to one or more competitions and/or games with prizes and/or discounts and/or promotions, in particular relating to at least a product contained in the magazine.

In a further aspect, in accordance with any one of the preceding aspects, the display comprises a plurality of different areas, the control unit being configured to determine a contact condition or a proximity condition of a user to an area of the areas, for a purpose of activating specific actions, in particular the display being of a touch-screen type.

In a further aspect according to any one of the preceding aspects, the machine comprises a plurality of release units, each active on a predetermined number of products in order to enable dispensing of at least a product thereof, the release unit moving the product to be released towards a passage zone designed to enable a transfer to the collecting compartment, the passage zone being interposed between the magazine and the display, the transfer to the collecting compartment occurring in particular by free fall, the release unit optionally being a spiral device.

In a further aspect, in accordance with any one of the preceding aspects, the display is an OLED display or a back-lit LCD display, for example being lit by a light source internal of the housing chamber.

BRIEF DESCRIPTION OF THE DRAWINGS

There now follows, by way of example, a description of a non-exclusive embodiment of an automatic product dispensing device, in accordance with what is described and illustrated.

The description will be performed herein below with reference to the accompanying figures of the drawings, provided by way of non-limiting example, in which.

DETAILED DESCRIPTION

Figure 1:
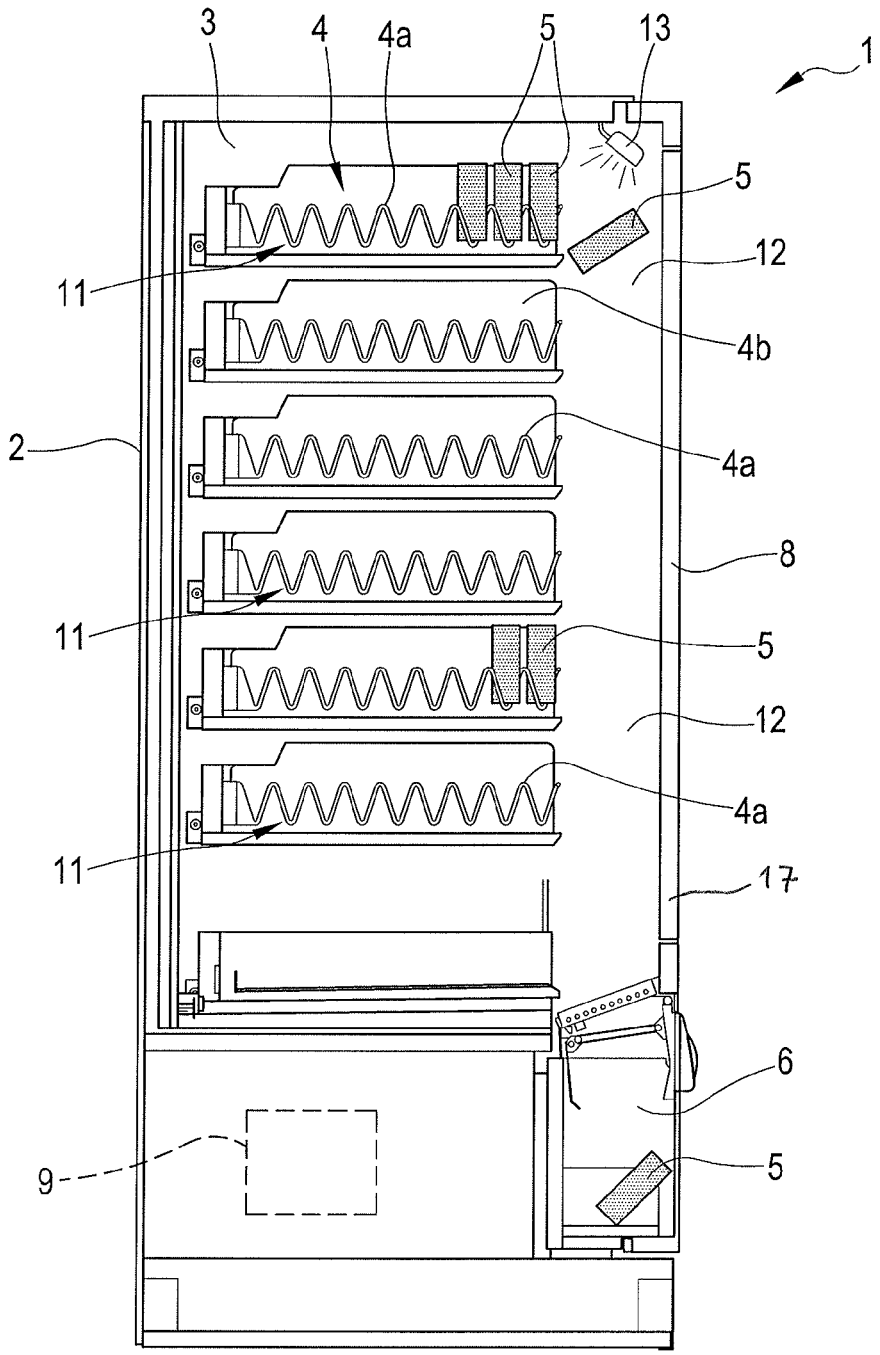
FIG. 1 is a schematic side view in section of an automatic product dispenser machine in accordance with an embodiment.

With reference to the accompanying figures, number 1 denotes in its entirety an automatic product dispenser machine, in accordance with that is set out herein below. The machine 1 is advantageously predisposed to contain and dispense food products and/or for restaurant services, or for any other product exhibiting contained overall dimensions, suitable for storing in a store of the machine.

As is visible in the accompanying figures of the drawings, the machine 1 first comprises a frame 2, in general parallelepiped in shape, which internally defines a housing chamber 3.

The housing chamber 3 accommodates a store 4 predisposed to contain a predetermined number of products 5 on sale. The store 4 can be a compartmented magazine in which the products 5 to be release are arranged, or, as shown in the accompanying figures, it can be a store subdivided into a plurality of planes or drawers 14, each in turn subdivided into a plurality of compartments 15 by means of suitable separating walls 16.

The machine further comprises a transparent window 17 for enabling visual access to the products to be dispensed such that the user can first view the desired product and then select it and collect it.

The window 17 is generally positioned at the frontal portion of the frame, accessible to the users and being of sufficient dimensions to enable optimum visual access to the products to be dispensed.

In the case of a machine with spiral dispensers, the window 17 is positioned/configured such as to give visual access to each of the first product of each spiral that is ready to be dispensed.

In general at least a release unit 11 is present, for enabling dispensing of a suitably-selected product.

The dispensing can comprise the dispensing unit's moving the product 5 towards or across a passage zone 12 up to a collecting compartment 6.

The passage zone 12 is in the specific illustrated example (see FIG. 1) interposed between the store 4 (or the containing chamber 3) and the window 17 of the machine.

Specifically, the dispensing unit 11 pushes the product towards the zone 12 and therefore the product too, by force of gravity, reaches the collecting compartment 6. Obviously other types of release can equally be provided, such as for example mobile collecting trays for actively conveying the product towards the collecting compartment. In the illustrated example, each release unit 11 is a spiral 4*a* type, a rotation of which determines the advancing of the respective products along respective shelves 4*b* and the fall thereof into the appropriate collecting compartment 6, usually positioned in a low part of the machine 1.

Naturally the magazine 4 can exhibit shapes and mechanisms that are different from the ones described and illustrated in the accompanying figures.

The machine 1 is further provided with a selecting device (figures from 2 to 4) operatively associated to the frame 2 in order to enable a user to select at least a product 5 contained in the magazine 4.

The selecting device 7 shown has a keyboard, though obviously touch-sensitive devices could be alternatively or contemporaneously used.

In a further embodiment the window 17 itself could be of a touch screen type and could therefore define the selecting device (as will be better clarified in the following).

The machine 1 advantageously comprises at least a display 89 associated to the frame 2 and interposed between the housing chamber 3 and an external environment to the dispensing machine.

In detail, the display 8 replaces the transparent glass (or plastic) window 17 which enables visual access to the products contained in the magazine 4. In this sense the display 8 is located at the front wall 2*a* of the frame and occupies a significant portion thereof, in general greater than 30% of the area.

In an embodiment the window 17 and the display 8 coincide in dimensions too.

In other terms the window 17 made of glass or plexiglass is totally replaced by a transparent display of like dimensions.

The transparent display 8 replaces the window 17 as a physical component, i.e. it incorporates all the functions thereof.

In any case the display 8 is interposed between the products 5 exhibited in the magazine and the external environment.

In still other terms the property of transparence of the display is utilised to enable the display 8 to take on the function of window and give visual access to the products required by the users.

The machine 1 is also provided with a control unit 9 active on the display 8 and configured such as to enable visualisation thereon of images and/or information, in particular (though not necessarily) indicative of the products 5 contained in the magazine 4.

Figure 2:
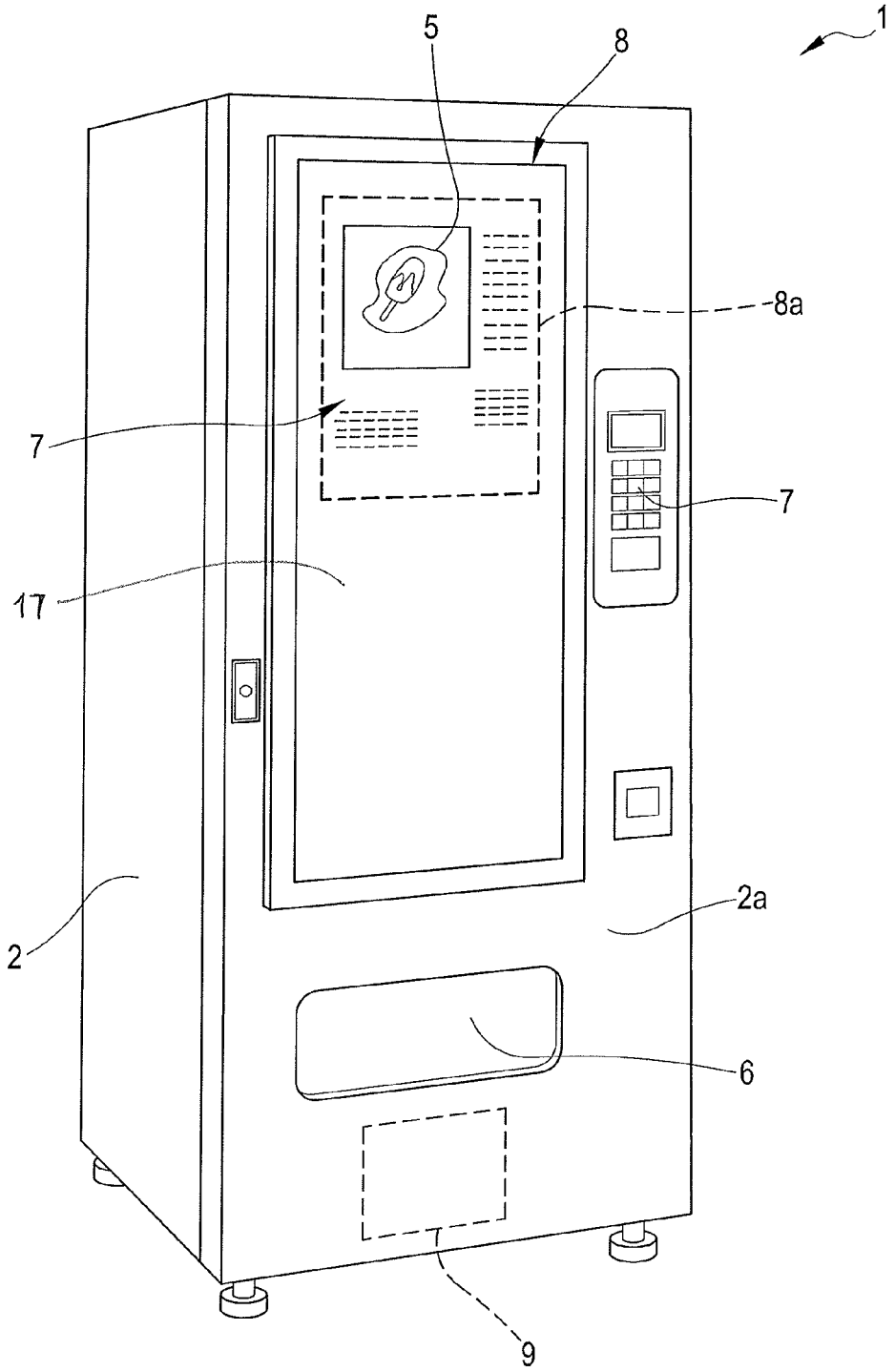
FIG. 2 is a perspective view of the machine of FIG. 1, illustrated in a first operating condition.
Figure 3:
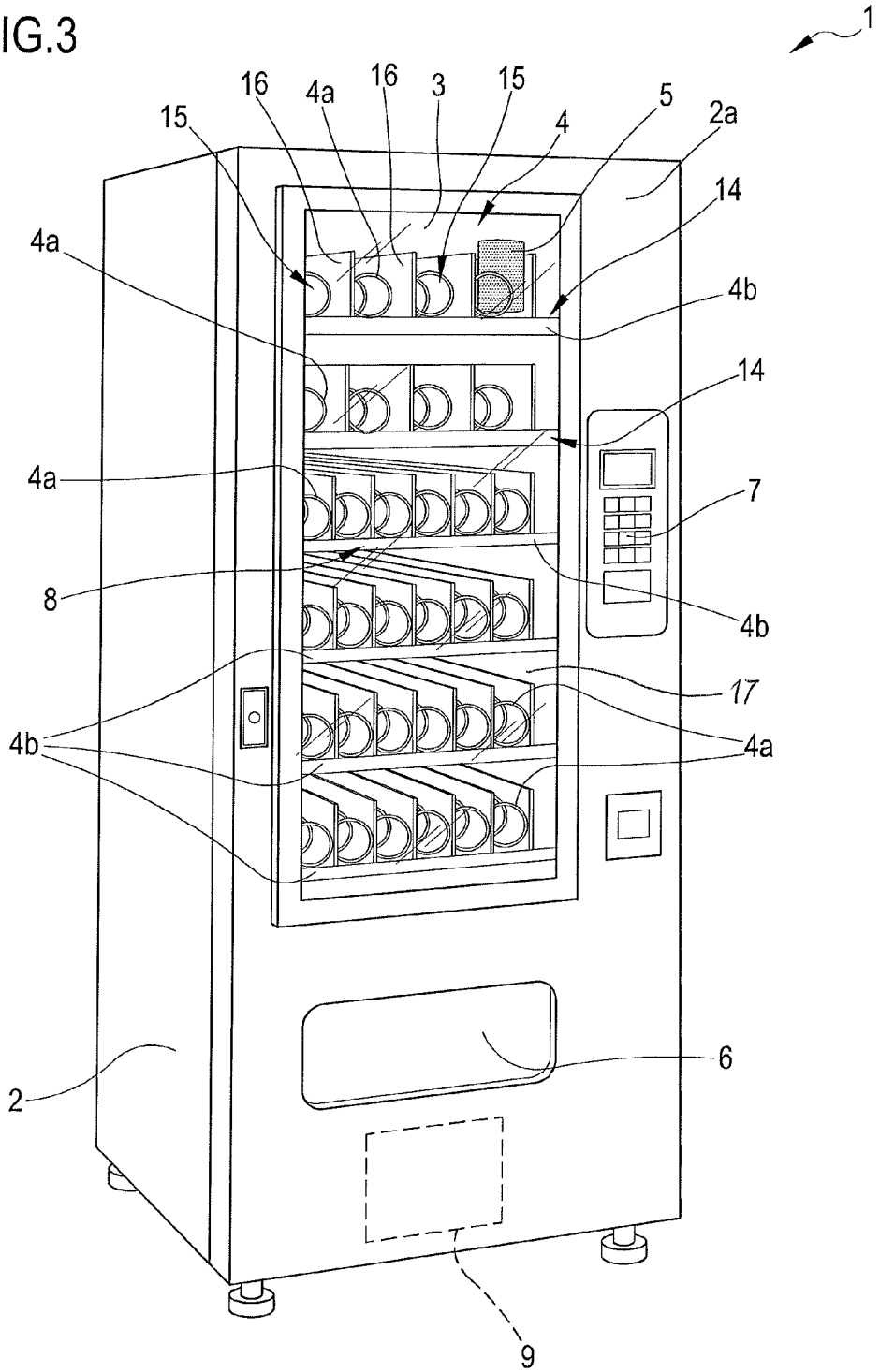
FIG. 3 is a further perspective illustration of the machine of the previous figures, illustrated in a second operating condition.

In more detail, the control unit 9 is configured such as to be active on at least a portion 8*a*, in particular a plurality of portions 8*a* and in general on the whole surface of the display 8 in order to switch it between a viewing condition (FIG. 2), in which the display reproduces at least an item of information and/or an image visible externally by a user, and at least a transparent condition (FIG. 3) in which at least a product 5 (and in general all the products) contained in the magazine 4 is visible through the portion 8*a* of the display 8.

Reference will hereinafter be made to a control unit 9 active on the whole display 8, its being understood that the unit 9 could be active exclusively on one or more portions 8*a* only thereof.

In an advantageous aspect of the present machine, the control unit is configured such as to switch the display 8 into the transparent condition (FIG. 3) such as to enable visibility of at least a real product 5 contained in the magazine 4, so that the user can see, transparently through the display, exactly the product that will be dispensed and released following the relative selection command on the selection device 7 by the action of the user himself.

In a further advantageous aspect of the present machine, the control unit 9 is configured to switch the display 8 into the viewing condition (FIG. 2) in which the products 5 contained in the magazine are not visible from outside. In this condition the display 8 can be used as a common monitor for displaying, for example, publicity or other information and/or images relating to the respective product or products 5 contained in the magazine 4, reproduced on the portion 8*a* of the display 8 or directly on the whole body thereof. In this way, the user is informed in relation to the products 5 contained in the magazine 4 and put in the condition to choose what she or he wishes to buy.

On the other hand the possibility of showing publicity via the display 8 means that the dispenser machine can be used as an advertising tool, adding functionality thereto.

The passage from the visualisation condition to the transparent condition (or to the superposed position as will be described herein below) might be commanded by proximity sensors able to perceive the nearness of a user or even of the selecting device 7 which, when activated, switches the display 8 from the viewing condition to the transparency/superposing condition.

The reverse passage, i.e. from the transparency/superposing condition to the viewing condition can be commanded by a time; after a certain lapse of time after use of the display, the control unit 9 returns the display 8 into the viewing condition.

As indicated above, the control unit 8 is configured such as to switch the display 8 into a superposing condition (FIG. 4), in which the display 8 reproduces at least a datum and/or an image (for example relating to one or more products 5 contained in the store 4) and exhibits, at the same time, transparent zones to enable at least partial vision of a product 5 contained in the magazine 4. In this condition the user is able to see both the information or images relating to the products that can be bought (shown on the display) and the real packages of the products 5 contained in the store 4 (see the examples of FIGS. 4 and 5).

With the aim of improving the visibility of the products contained in the magazine 4 from outside, in the transparent condition (FIG. 3) and the superposing condition (FIG. 4), the machine 1 comprises one and in detail a plurality of light sources 13 (only schematically illustrated) arranged internally of the chamber 3 and active on the products 5 present in the magazine 4.

Each light source (in general an LED) is switchable between a non-operative condition, in which it does not emit light, and an operative condition, in which it illuminates at least a product 5 contained in the or in an area of the magazine 4.

Figure 4:
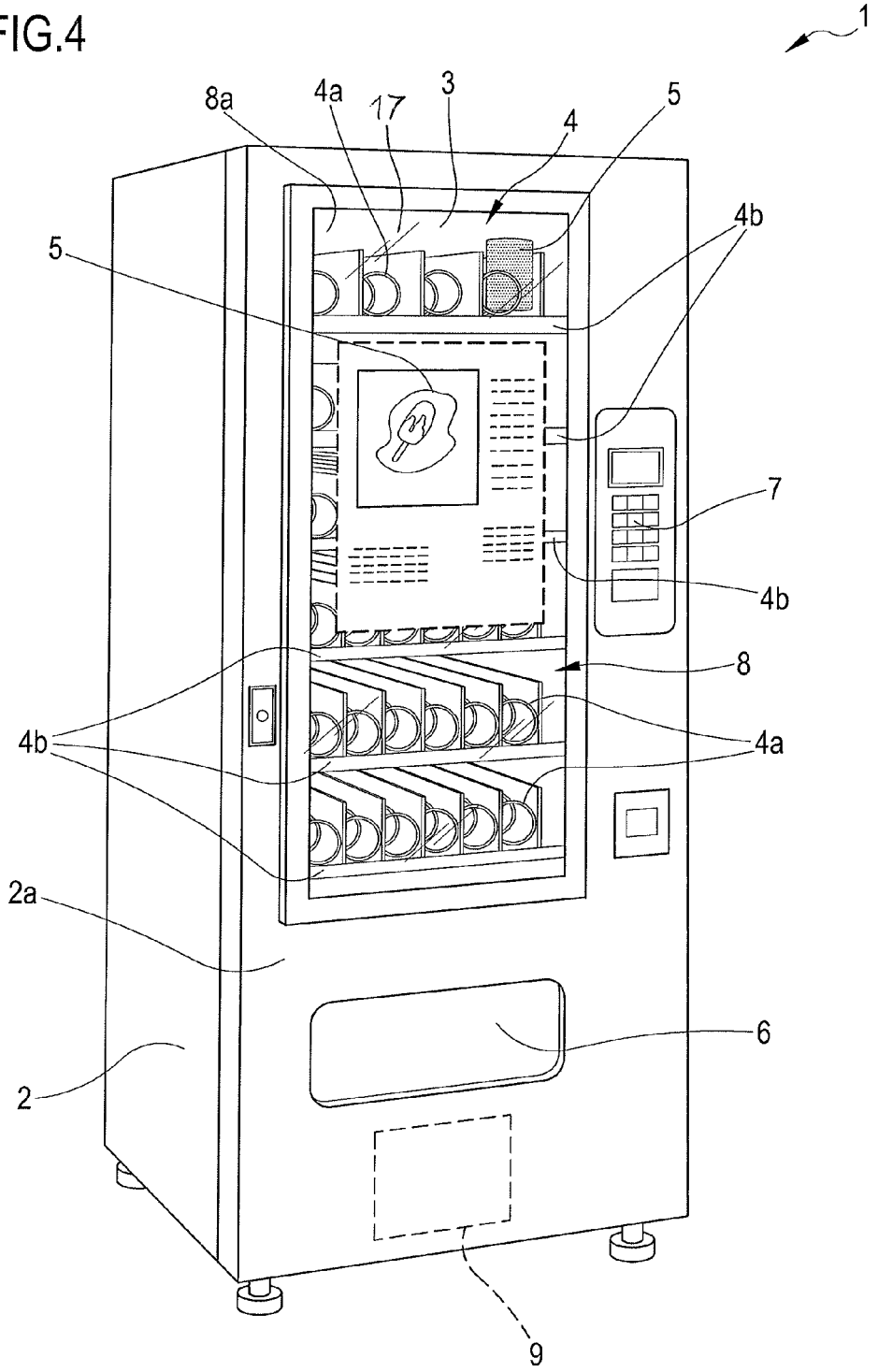
FIG. 4 is a further perspective illustration of the machine of the preceding figures in a third operating condition.

The control unit 9 is advantageously configured such as to switch each light source from the non-operative condition to the operative condition, when the control unit switches the display 8 into the transparent condition (FIG. 3) and/or the superposing condition (FIG. 4).

According to an advantageous aspect of the present machine, when the display 8 is in the viewing condition (FIG. 2) or superposing condition (FIG. 4), the control unit 9 is configured such as to send to the display 8 a signal reproducing a predetermined image and/or a writing and/or film.

Figure 5:
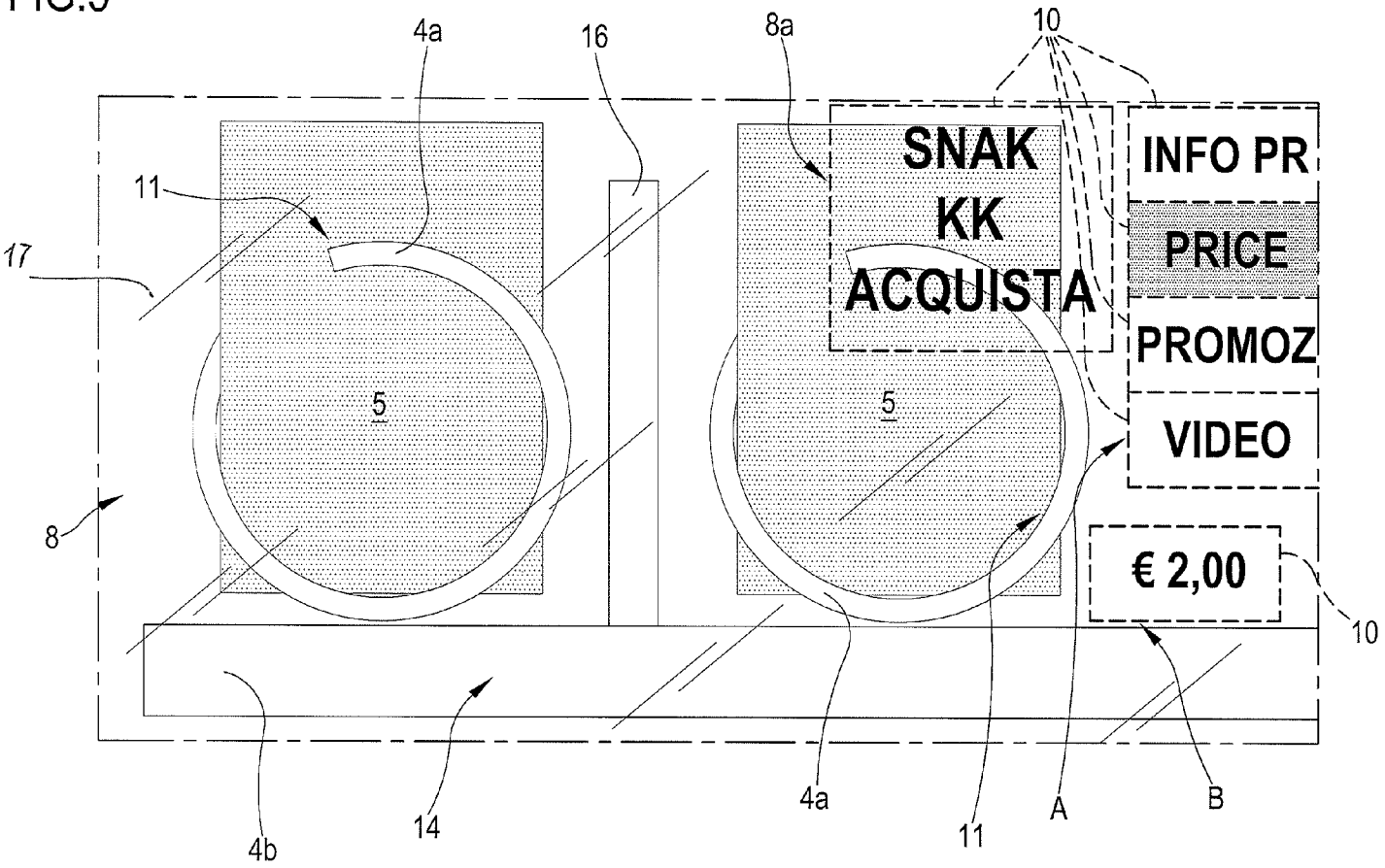
FIG. 5 is an enlarged view of a portion of the glass screen of the machine in the third operating condition.

In particular, the reproduction signal emitted by the control unit 9 can command the reproduction of at least a selecting menu, optionally interactive (for example indicated by the region A in FIG. 5).

Alternatively or in association with the menu, the signal emitted by the control unit 9 can also require the display 8 to visualise at least an item of information relating to the price of a product 5 contained in the magazine 4.

Alternatively or in association with the above, the signal emitted by the control unit 9 can also require the display 8 to show at least an item of information relating to the calories present in at least a product 5 contained in the magazine 4.

Alternatively or in association with the above, the signal emitted by the control unit 9 can command the display 8 to visualise at least an item of information relating to the ingredients present in at least a product 5 contained in the magazine 4.

Alternatively or in association with the above, the signal emitted by the control unit 9 can require the display 8 to visualise at least an item of information indicating the origin of at least a product 5 contained in the magazine 4.

Alternatively to or in association with the above, the signal emitted by the control unit 9 can command the display 8 to reproduce at least a film, in particular correlated to at least a product contained in the magazine 4.

Alternatively to or in association with the above, the reproduction signal emitted by the control unit 9 can command the display 8 to reproduce at least a film and/or a publicity slogan, in particular correlated to at least a product 5 contained in the magazine 4.

Alternatively to or in association with the above, the reproduction signal emitted by the control unit 9 can require the display 8 to visualise at least an item of information relating to one or more competitions and/or games with prizes, in particular correlated with at least a product 5 contained in the magazine 4.

Alternatively to or in association with the above, the reproduction signal emitted by the control unit 9 can require the display 8 to visualise at least a promotional message, in particular correlated to at least a product contained in the magazine 5.

Alternatively to or in association with the above, the reproduction signal emitted by the control unit 9 can require the display 8 to visualise at least a discount, in particular correlated to at least a product 5 contained in the magazine 4.

In an advantageous aspect of the present machine, the display 8 can also be a manual contact display, or "touch screen" predisposed firstly to enable selection (for the purposes of dispensing) of a specific product contained in the magazine and possibly also the visualisation of one or more items of information and/or films and/or promotions reproduced by the display 8 via direct contact there-with. In this case, the display 8 corresponds, at least in part, to the selecting device 7, for this the direct contact with the display 8 by the user activates the control unit 9 to respond to the selection made. By observing in particular the exemplary illustration of FIG. 5, it can be seen how the display 8, interposed between the user and the products 5 contained in the magazine, comprises a plurality of different active areas 10, generally of the touch-screen type, which carry information and/or images.

In its simplest form, there can be just a single area 10 interposed between the user and the product to which the area 10 relates, such that in the superposing condition the user can see both the product 5 and the corresponding area 10 which, in conditions of proximity or contact by a user (for example with a finger), enables activation of a specific action (typically dispensing the selected product).

In still other terms the control unit 9 is configured such as to determine the contact or proximity condition of a user to one of the areas, reacting to contact/proximity by means of the action possibly indicated in the area in written form.

In the case of the example of FIG. 5, the contact with the area 10 reporting the acquisition wording enables activation of the release unit 11, enabling dispensing of the product 5 which is aligned in the view of the user to the selected area 10.

Obviously the presence of a display 8 of the touch-screen type enables configuring the machine substantially as desired.

Still with reference to the example of FIG. 5, there might be present a plurality of areas 10 in vertical alignment conditions such as to define a first region A. The contact or proximity of a user with any of the areas 10 reported commands activation of a specific action.

For example, the selection of the area which reports the wording "price" can cause the price of the product to appear in a second region, indicated by B.

The activation of the area reporting the wording "product information" can activate, in the region B, a representation of data correlated to the product (for example the calories or the absence of gluten).

Alternatively the contact with the area 10 reporting the wording "video" can take the display 8 from the superposed condition to the viewing condition and the advertising relating to the product can be shown on the whole display.

Thus the display 8 of the type described enables gathering together various technical functions of distinct devices of the machines of the prior art; apart from enabling transparent vision of the products, it enables display of information superposed thereon in aligned conditions with respect to an external user; the possibility of reporting wordings and/or images of various nature and to associate them to a touch screen further enables configuring a substantially infinite number of possible actions and operations; the screen can further be used as a common LCD monitor for reproducing films or other things.

As specified above, the control unit 9 configured such as to command the display 8 to reproduce one or more items of information and/or films and/or promotions, at a substantially aligned level on the visual field of a user located frontally of the machine. In other words, the control unit 9 orders the display 8 to reproduce the information and/or the films and/or the promotions at the upper part of the display in such a way as to best capture the attention of the users who can thus see the information reproduced in complete comfort. In an advantageous aspect of the present machine, the display 8 could for example be based on a technology of the OLED type.

In particular, the OLED display comprises a slim film which exhibits a substantially sandwich structure provided with: a support, which can be a glass pane, or a transparent plastic film; a transparent electrode having an anode function; some organic layers which constitute the active light emitting material; and a second electrode having a cathode function, which in general consists of a reactive metal.

The device can be encapsulated in a waterproof material, also resistant to oxygen, pollutants and the like and also shockproof.

By applying a tension to the electrodes, there is an injection of positive and negative charges from the electrodes through the active organic layer. The recombination of the positive and negative charges give rise, by electroluminescence, to emission of photons.

The photons are emitted through the anode and the transparent substrate.

The OLED display constitutes an active matrix display, the transistor structure of which is integrated into the display and is made up by at least two transistors for each pixel. The transistors are connected in sequence to the anode and cathode lines and are able to keep each pixel active up to the following scansion period.

The display 8 is therefore colour and can emit light without requiring additional components for illumination thereof, and in the non-active condition it is totally transparent, while in the active condition it can also be completely darkened.

It is clear that other types of display could equally be used as alternatives.

Merely by way of example, an LCD monitor could be used, modified such as to be opaque when on and transparent when off; in particular the monitor might exploit an internal light of the housing chamber directed towards the display such as to back-light it and make information/images visualised visible.

The automatic product dispensing machine according to what has been described solves the problems encountered in the prior art and attains important advantages.

In particular, the above-described machine is able to provide users with a wide range of information and/or images and/or films relating to the products contained internally of the magazine, and at the same time it enables viewing, if necessary, of the real packages of the products present in the magazine. This characteristic enables users to have a complete perception of the products on sale, while visualising all of the necessary information and the images and/or films correlated thereto.

LEGEND

1 Automatic dispensing machine
2 Frame
2*a* Front wall of the frame
3 Housing chamber
4 Magazine
4*a* Spirals
4*b* Shelves
5 Products
6 Collecting compartment
7 Selection device
8 Display
8*a* Portion of display
9 Control unit
10 Display areas
11 Release unit
12 Passage zone
13 Light source
14 Drawer
15 Compartment
16 Separating walls
17 Window

The invention claimed is:

1. An automatic product dispensing machine, comprising:

a frame delimiting at least a housing chamber;

a magazine, operatively arranged internally of the housing chamber, the magazine being configured to contain a plurality of products;

at least a display associated to the frame and interposed between the housing chamber and an environment external to the dispensing machine;

a control unit acting on the display and configured to enable visualisation of images and/or items of information on the display;

wherein the display is transparent, enabling direct visual access to the magazine and to the products contained therein and to be dispensed, the control unit being configured to be selectively active on at least a portion of the display in order to visualise images and/or items of information on the display itself, wherein the control unit is configured to be active on at least the portion of the display in order to switch the display between at least two of following three conditions:

a visualising condition, in which the display reproduces on at least a portion thereof an item of information and/or an image which is visible externally by a user and there is no substantial visual access to the housing chamber through the portion;

a transparent condition, wherein at least a product contained in the magazine is visible through the portion of the display;

a superposing condition in which at least a portion of the display reproduces an item of information and/or an image which is visible externally to a user and at least a product contained in the magazine is at least partly visible through the portion, and wherein the display is a touch-screen, the contact with an area of the touch-screen display in the superposing condition enables activation of a release unit, enabling dispensing of the product aligned in the view of the user to the selected area.

2. The machine of claim 1, wherein the display is dimensioned and positioned with respect to the magazine in such a way as to guarantee visual access to all the real products ready for dispensing following selection by the user.

3. The machine of claim 1, comprising:

a selecting device operatively associated to the frame to enable a user to select at least a product contained in the magazine;

a collecting compartment associated to the frame to enable collection of at least a product released from the magazine; and wherein the control unit is configured to switch the portion of the display into the transparent condition in order to enable at least partial visibility of a real product contained in the magazine and predisposed to be released following a selection command emitted by the selecting device following an action of a user.

4. The machine of claim 1, wherein the machine comprises at least a release unit of at least a product selected via the selecting device, the release device being active to move a real product visible from the outside in the transparent condition of the display towards the collecting compartment.

5. The machine of claim 1, wherein the control unit is configured to switch the portion of the display into the visualizing condition in which the product contained in the magazine is not visible from outside.

6. The machine of claim 1, wherein the display is configured to reproduce at least an item of information and/or an image of the product, selectable by the user via the selecting device.

7. The machine of claim 1, further comprising at least a light source switchable between a non-operating condition, in which the light source does not emit light, and an operating condition, in which the light source illuminates a predetermined number of products contained in the magazine, the control unit switching the light source from the non-operative condition to the operative condition when the control unit switches the display into the transparent condition.

8. The machine of claim 7, wherein the light source is arranged internally of the housing chamber and acts on the magazine.

9. The machine of claim 7, wherein the control unit is configured to switch the light source from the non-operative condition to the operative condition, when the control unit switches the display into the superposing condition.

10. The machine of claim 9, wherein the control unit is configured to send to the display, when the display is in the visualising condition or in the superposing condition, a reproduction signal included in the group consisting of:

an interactive menu, an item of information indicating a price of a product contained in the magazine, an item of information describing a quality of at least a product contained inthe magazine, an item of information describing a quantity of at least a product contained in the magazine, at least an item of information relating to one or more competitions, at least an item of information relating to one or more games with prizes, at least an item of information relating to one or more discounts, at least an item of information relating to one or more promotions, relating to at least a product contained in the magazine.

11. The machine of claim 1, wherein the display comprises a plurality of different areas, the control unit being configured to determine a contact condition or a proximity condition of a user to an area of the areas, for a purpose of activating specific actions associated to the respective areas.

12. The machine of claim 1, comprising a plurality of release units, each active on a predetermined number of products in order to enable dispensing of at least a product thereof, the release unit moving the product to be released towards a passage zone configured to enable a transfer to the collecting compartment, the passage zone being interposed between the magazine and the display.

13. The machine of claim 12, wherein the transfer to the collecting compartment occurs by free fall, the release unit being a spiral device.

14. The machine of claim 1, wherein the display comprises a slim film which exhibits a substantially sandwich structure provided with:

a support including a glass pane or a transparent plastic film;

a transparent electrode having an anode function;

a predetermined number of organic strata, constituting an active light-emitting material; and a second electrode, having a cathode function, including a reactive metal.

15. The machine of claim 14, wherein the film is encapsulated in a waterproof material resistant to water and oxygen and to pollutants, the material being shockproof.

16. The machine of claim 1, wherein the display is an active matrix display in which a transistor structure is integrated into the display and is composed by at least two transistors for each pixel, the transistors being connected in sequence to anode lines and cathode lines and being able to keep each pixel active from a first scansion period to a following scansion period.

17. The machine of claim 1, wherein the machine comprises a compartmented magazine in which the products to be release are arranged or it can be a store subdivided into a plurality of planes or drawers each in turn subdivided into a plurality of compartments by means of suitable separating walls.

* * * * *